US007365698B2

(12) United States Patent
Dwyer et al.

(10) Patent No.: US 7,365,698 B2
(45) Date of Patent: Apr. 29, 2008

(54) DIPOLE ANTENNA

(75) Inventors: Bradley Lance Dwyer, Forest Hill (AU); Warwick Thomas Armstrong, Warrandyte (AU); Robert Andrew Daly, Chirnside Park (AU); Mark Anthony Mezzapica, Mosman (AU)

(73) Assignee: RF Industries Pty Ltd, North Rocks, South Wales (AU)

( * ) Notice: Subject to any disclaimer, the term of this patent is extended or adjusted under 35 U.S.C. 154(b) by 0 days.

(21) Appl. No.: 11/465,159

(22) Filed: Aug. 17, 2006

(65) Prior Publication Data

US 2007/0040758 A1 Feb. 22, 2007

(30) Foreign Application Priority Data

Aug. 19, 2005 (AU) ..... 2005904524

(51) Int. Cl.
*H01Q 9/16* (2006.01)

(52) U.S. Cl. ..... 343/792; 343/795

(58) Field of Classification Search ..... 343/795, 343/700 MS, 792, 790, 812, 813
See application file for complete search history.

(56) References Cited

U.S. PATENT DOCUMENTS

| | | | | |
|---|---|---|---|---|
| 5,198,831 | A | 3/1993 | Burrell et al. | |
| 6,339,408 | B1 | 1/2002 | Edvardsson et al. | |
| 6,809,697 | B2 * | 10/2004 | Churng-Jou et al. | 343/792 |
| 7,164,389 | B1 * | 1/2007 | Platt | 343/790 |
| 2006/0232493 | A1 * | 10/2006 | Huang et al. | 343/895 |

FOREIGN PATENT DOCUMENTS

| | | |
|---|---|---|
| EP | 0274592 | 7/1988 |
| EP | 0521511 | 1/1993 |
| WO | WO2004/093243 | 10/2004 |

* cited by examiner

*Primary Examiner*—Hoang V Nguyen
(74) *Attorney, Agent, or Firm*—Baker & Daniels LLP

(57) ABSTRACT

A method of manufacturing a dipole antenna comprises the steps of forming first and second radiating elements on the surface of a flexible substrate, the radiating elements including respective feed points for making operative electrical contact with a feed line including corresponding first and second feed conductors. The radiating elements are arranged on the substrate such that, in use, an input impedance of the dipole antenna is substantially matched to a characteristic impedance of the feed line over a selected frequency band. The flexible substrate is then formed into a substantially cylindrical shape. The resulting antenna comprises an integral dipole antenna member having radiating elements disposed on a surface of a substantially cylindrical substrate. The antenna avoids the need to separately manufacture the radiating elements, and subsequently to assemble the elements to form a dipole antenna. The antenna is simple to construct, has a relatively low number of mechanical and electrical joints and contacts, and may provide improved mechanical stability and electrical performance as compared with prior art antennas.

20 Claims, 8 Drawing Sheets

DIPOLE ANTENNA

FIELD OF THE INVENTION

The present invention relates to antenna devices, and more particularly to corporately-fed collinear array dipole antennas, such as are commonly used in mobile radio and telephone communication systems, in which signals must be transmitted and received over a wide range of angles around the antenna.

BACKGROUND OF THE INVENTION

Collinear array dipole antennas are well known for providing radiation over a wide range of angles around the antenna, and more particularly for providing omnidirectional radiation. Known types of collinear array antennas include the Franklin antenna, which is a series-fed collinear array typically manufactured using a coaxial cable feed line, as well as other, similar, structures. Such antennas generally include a series-fed sequence of end-fed, half wavelength radiators, which produce a substantially uniform circular radiation pattern in the azimuth.

However, most types of series-fed antenna inherently possess a narrow bandwidth. Each successive radiator is ideally separated from the source by an additional half wavelength at the designed centre frequency of the antenna. However, at frequencies different from the design frequency, the radiators are no longer separated by a half-wavelength. The resulting cumulative change in phase degrades the antenna performance at such frequencies, by causing the peak of the radiated beam to tilt up and down with increasing and decreasing frequency, thereby causing variations in radiation intensity at the horizon.

A solution to the aforementioned problem of series-fed antennas is to use a corporate, or parallel, feed arrangement, in which a dipole antenna array is fed from a common array feed point over equal length transmission paths. In a corporate feed arrangement, the phase shift from the feed point to each dipole will be substantially equal over a broad range of frequencies. The result is a more uniform radiation pattern over the bandwidth of the antenna.

One common method used to form collinear arrays of corporate-fed radiators is to side mount centre-fed dipoles off a common mast. The radiators are fed with a branched feed as previously described, to eliminate beam tilting as a function of frequency. The side mounted dipoles are typically spaced symmetrically around and close to the mast, at 90 degree increments, in order to minimize the deviation from circularity in the azimuth of each dipole. However, the cables and the mast of such antennas act as parasitic elements which reflect energy, resulting in a cardioid pattern, rather than circular pattern, of radiation emitted by each dipole. While this may be offset to some degree by the 90 degree incremental placement of the dipoles around the mast, the overall radiation pattern nonetheless deviates from circularity, and additionally the centre of the main lobe of the radiation pattern will deviate above and below the horizon to some degree, as the pattern is viewed from various sectors in the azimuth.

In an attempt to overcome the disadvantages associated with side-mounted dipoles, alternative dipole structures have been developed which can be symmetrically and collinearly mounted to produce substantially omnidirectional radiation patterns. Such antennas generally employ cylindrical or tubular radiating elements which may be mounted coaxially with a support mast to provide a uniform radiation pattern. However, precise relative placement of the cylindrical elements is essential in such antennas, since the spacing between elements of each dipole critically affects the input impedance, which in turn determines the degree of matching with the feeding transmission line and thereby the efficiency and frequency response of the antenna. The necessity to ensure accurate positioning of the individual antenna elements leads to increased complexity and cost in the design and construction of antennas of this type. In many instances, individual testing and fine tuning of an assembled antenna array is necessary to ensure that the resulting antenna meets specified bandwidth and radiation pattern requirements.

Furthermore, the large number of mechanical and electrical joints that may be required in the assembly of antennas formed from individual cylindrical elements may result in other forms of degradation in antenna performance. In particular, electrical and mechanical joints between individual metallic components of an antenna may result in a parasitic non-linear response, causing a form of degradation known as Passive Inter-Modulation distortion (PIM). In practice, PIM can result in crosstalk between signals on different RF carriers within the antenna bandwidth, and it is therefore essential to minimize this type of distortion. A typical specification for maximum acceptable PIM in a mobile radio or telephony system is −150 dBc for two carriers at 20 watts. It may be very difficult to meet this specification with an antenna having a large number of mechanical joints, in addition to which the long-term stability of antenna performance may be an issue. For example, an antenna deployed in a typical mobile telephony application will be mounted on a tower where it is subjected over time to wind, electrical hum and mechanical vibrations which may cause mechanical joints to shift or loosen, resulting in degradation of PIM performance over time.

Accordingly, there is a need for an improved collinear array dipole antenna structure that is able to provide a wide-angle radiation pattern, preferably an omnidirectional pattern, along with a broad bandwidth, while mitigating the aforementioned problems of known antennas of this type.

SUMMARY OF THE INVENTION

In one aspect, the present invention provides an antenna for transmitting and receiving radio signals within a selected frequency band, including:

- an integral dipole antenna member comprising a substantially cylindrical substrate formed from a flexible dielectric sheet material which has disposed on a surface thereof first and second radiating elements in a substantially collinear arrangement parallel to a longitudinal axis of the cylindrical substrate; and
- a feed line including at least first and second feed conductors operatively in electrical contact with said first and second radiating elements respectively, to conduct signals to and from the radiating elements,
- wherein the radiating elements are arranged on the substrate such that in use an input impedance of the dipole antenna member is substantially matched to a characteristic impedance of the feed line over the selected frequency band.

Accordingly, the geometrical structure and relative location of the radiating elements, which are critical to achieving suitable matching between the feed conductors and the dipole antenna, are determined by the formation of the elements on the substrate. The invention therefore avoids the requirement for separate manufacture of the radiating elements, and subsequent assembly to form a dipole antenna.

It will therefore be appreciated that an antenna in accordance with embodiments of the present invention enables a number of advantages to be realized when compared with known antenna structures. Such an antenna may be simpler to construct, with fewer mechanical and electrical joints and contacts, thereby providing superior mechanical stability and a reduction in PIM. The formation of the critical radiating elements on a common substrate substantially mitigates, or may eliminate altogether, the need for post-assembly adjustment or tuning of radiating dipoles to achieve suitable matching over the desired frequency band. Overall, these advantageous features may result in reduced manufacturing costs for such an embodiment, as well as improved technical performance of the antenna.

While the invention generally requires that the dipole antenna member include at least first and second radiating elements, it will be appreciated that in some embodiments more than two radiating elements may be provided.

In preferred embodiments, the substrate is formed into a substantially cylindrical shape by curving or rolling after the radiating elements have been formed on a surface thereof. The radiating elements may be formed using conventional printed circuit board (PCB) fabrication techniques. As will be appreciated, the ability to use well-established PCB design and manufacturing methods not only simplifies design and fabrication, but also provides a very high degree of precision and repeatability in the formation of the radiating elements, at a relatively low cost.

Additionally, well known PCB and microstrip design techniques may be used to provide additional circuit elements, such as parallel capacitive structures, in the radiating elements in order to match the input impedance of the dipole antenna member to the characteristic impedance of the feed line. The high degree of control that may be achieved over such circuit elements may enable very good matching to be achieved over a broad frequency range, thereby enabling the design and fabrication of antennas having wide bandwidth.

Preferably, the length of each radiating element along the axis of the cylindrical substrate is approximately equal to, or slightly greater than, one quarter wavelength at a predetermined central frequency within the selected frequency band. In the presence of a central support shaft, using precisely one-quarter wavelength radiating elements results in a dipole antenna member which presents as a short-circuit at the input terminals. Advantageously, the realisation of radiating elements having a length slightly greater than one-quarter wavelength avoids this problem. A shunt capacitive element, such as an interdigital planar capacitor, may be formed between the radiating elements in order to match input impedance with the characteristic impedance of the feed line.

In embodiments of the invention intended to provide an omnidirectional radiation pattern, each radiating element may be formed to provide substantially uniform coverage around a circumference of the substantially cylindrical substrate, whereby an antenna having a substantially uniform radiation pattern in azimuth is provided. Alternatively, the radiating element may be formed to provide non-uniform coverage around the substrate, whereby an antenna having an alternative desired radiation pattern in azimuth may be provided.

For an omnidirectional antenna, it is advantageous that the dipole elements on the substrate form a complete cylinder, having a closed circular cross-section. However, for other desired radiation patterns it may not be necessary for the dipole elements on the substrate to be complete, and, for example, a partially formed cylindrical dipole element may be used which includes an opening or gap in the cross-section, so that the cross-section of the element forms an arc of a complete circle. Such a gap in the cross section of the dipole elements may be achieved by providing radiating elements that do not completely cover the surface of the cylindrical substrate around a circumference thereof. Alternatively or additionally the substrate may be only partially rolled, to form a cylinder having an opening or gap.

While it is preferred that the cross-section of the cylindrical substrate be circular in the case of a uniform omnidirectional antenna, in some applications it may be desirable to provide a substantially cylindrical substrate having a non-circular cross-section, such as an ovoid, lenticular or biconvex cross-section, for example to provide higher radiation intensity and/or greater coverage along a major axis of the antenna, than along a perpendicular minor axis.

In one particularly preferred embodiment, the cylindrical substrate is formed around a disc positioned proximate to the centre of the dipole antenna. In this embodiment, the disc and substrate include cooperating connecting members for fixing the substrate in position around the disc, and in particular the disc preferably includes projecting sprockets, and the substrate includes corresponding holes, such that the flexible substrate may be formed into a cylinder around the disk by fixing the sprockets of the disc into the holes of the substrate.

Advantageously, a conductive (e.g. metallic) disc is used, and the sprockets thereof pass through the holes and are fixed in place by soldering to one of the radiating elements. The disc may thereby be incorporated within the feed line, by providing electrical contact between one of the electrical feed conductors and the corresponding radiating element.

Again, this preferred arrangement is advantageous in simplifying construction, and mitigating sources of variability in assembly that may have undesirable consequences, such as reducing the efficiency, impedance matching and/or bandwidth or the antenna, or causing an increase in PIM.

It is further preferred that the antenna includes a central support shaft, and the dipole antenna member is mounted on the shaft. The shaft may be made of a conductive metal, such as aluminum or brass, and is preferably grounded to impart additional electrical stability to the antenna. In a particularly advantageous arrangement, the disc around which the dipole antenna member is formed includes a central hole, through which the support shaft passes, such that the antenna member may be mounted on the shaft by soldering or welding of the disc to the shaft. In this arrangement, a ground conductor of the feed line may be soldered to the disc, which is in turn in electrical contact with the grounded central support shaft, thereby providing an extremely stable grounding arrangement for the antenna.

In another aspect, the invention provides an antenna for transmitting and receiving radio signals within a selected frequency band, including:

an antenna array including a plurality of collinear integral dipole antenna members, each having first and second radiating elements disposed on a surface of a substantially cylindrical substrate; and a corporate feed structure directing a plurality of feed lines, each including respective first and second feed conductors operatively in electrical contact with each of said first and second radiating elements in the antenna array, wherein the radiating elements of each antenna member are arranged on the corresponding substrate such that in use an input impedance of each dipole antenna member is substantially matched to a characteristic impedance of the corresponding feed line over said selected frequency band.

Preferably, the corporate feed structure includes one or more power dividers configured to divide and transmit an in-phase signal in parallel through a transmission line to each of the dipole antenna members. Advantageously, feeding in-phase signals to each antenna member results in an untilted radiation pattern, i.e. a radiation pattern having a peak substantially located around the horizon of the antenna.

In alternative embodiments, the corporate feed structure may be arranged to divide a signal into parallel paths through transmission lines to each of the antenna members, the divided signals having a predetermined phase relationship so as to introduce a desired beam tilt into the radiation pattern of the antenna. Accordingly, in some embodiments the invention provides for a controlled beam tilt, and in particular a down tilt may be advantageous in certain applications, such as mobile telephony systems, where the mobile units operating within the coverage area of the antenna may be generally located beneath the plane of the antenna.

The antenna array preferably further includes a central support shaft, wherein each antenna member in the array is mounted coaxially along the length of the shaft. In preferred embodiments, the dipole antenna members in the array are mounted approximately equally distant from one another, however it is an advantage of the present invention that the precise placement of the antenna members is not especially critical. For example, the centre-to-centre spacing of the dipole antenna members may be approximately within the range of 0.6 to 1 wavelength, and the low sensitivity to the location of the individual dipoles may result in greater ease of assembly, and a corresponding reduced cost of manufacture.

It is particularly preferred that the central support shaft be grounded, and that a ground conductor of the feed line feeding each antenna member be in electrical contact with the shaft. In a particularly preferred embodiment, the substrate of each dipole antenna member is formed around a metallic disc which includes a central hole, through which the support shaft passes, and which is in electrical contact with one of the radiating elements, such that an extremely stable grounding arrangement is provided.

In yet another aspect, the invention provides a method of manufacturing a dipole antenna, including the steps of:

forming first and second radiating elements on the surface of a flexible substrate, the radiating elements including respective feed points for making operative electrical contact with a feed line including corresponding first and second feed conductors, wherein the radiating elements are arranged on the substrate such that in use an input impedance of the dipole antenna is substantially matched to a characteristic impedance of the feed line over a selected frequency band;

forming the flexible substrate into a substantially cylindrical shape having a longitudinal axis; and wherein the first and second radiating elements are formed on the substrate such that they are disposed in a substantially collinear arrangement parallel to said longitudinal axis.

Advantageously, therefore, the assembly of an antenna in accordance with this manufacturing method is simpler, and involves making fewer mechanical and electrical joints and contacts than would typically be the case with known comparable antenna structures. Furthermore, the geometrical structure of the radiating elements, which is critical to achieving suitable matching between the antenna and the feed line, is fully determined by the formation of the elements on the substrate, thereby significantly reducing, or eliminating altogether, the need for any post-assembly adjustment or tuning of the dipole to achieve suitable matching over the desired bandwidth.

In a particularly preferred embodiment, the step of forming the substrate into a substantially cylindrical shape may include rolling the substrate into a cylinder, for example around a suitably shaped supporting disc. The disc and substrate preferably include cooperating connecting members for fixing the substrate in position around the disc. For example, the disc may include projecting sprockets and the substrate corresponding holes, such that the flexible substrate may be formed into a cylinder around the disc by fixing the sprockets of the disc into the holes in the substrate, such as by soldering.

Accordingly, the method may further include forming holes in the flexible substrate, rolling the flexible substrate around the disc such that corresponding projecting sprockets of the disc are received within the holes, and fixing the sprockets in place within the holes. It is particularly preferred that the disc be metallic, such that fixing the sprockets in place within the holes may be achieved by soldering.

Comprises/comprising and grammatical variations thereof when used in this specification are to be taken to specify the presence of stated features, integers, steps or components or groups thereof, but do not preclude the presence or addition of one or more other features, integers, steps, components or groups thereof.

BRIEF DESCRIPTION OF THE DRAWINGS

Preferred embodiments of the invention are described with reference to the accompanying drawings, wherein like reference numerals refer to like features, in which.

DETAILED DESCRIPTION OF PREFERRED EMBODIMENTS

Figure 1A:
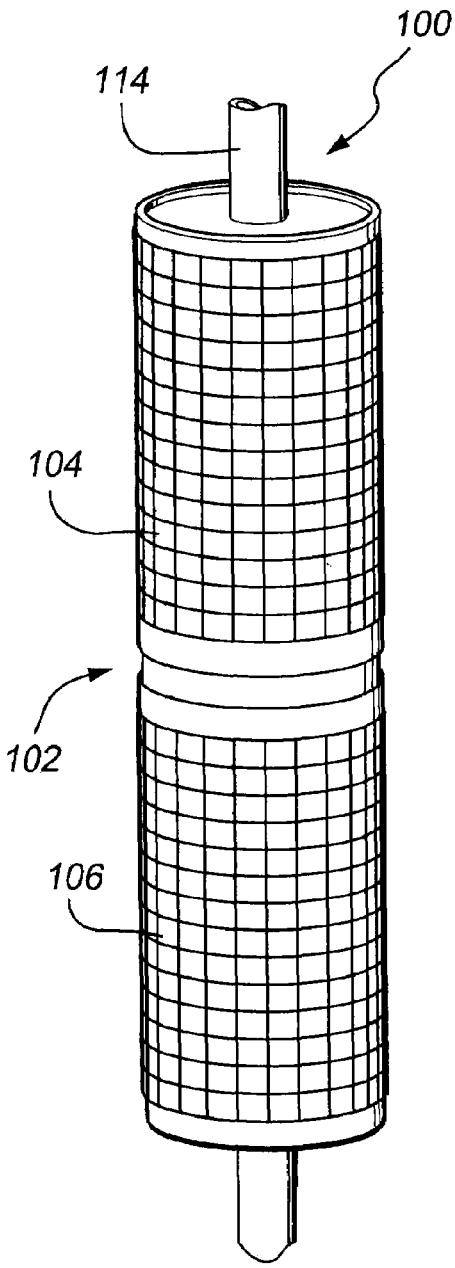
FIGS. 1A and 1B show perspective and cross-sectional views, respectively, of an antenna according to an embodiment of the invention.
Figure 1B:
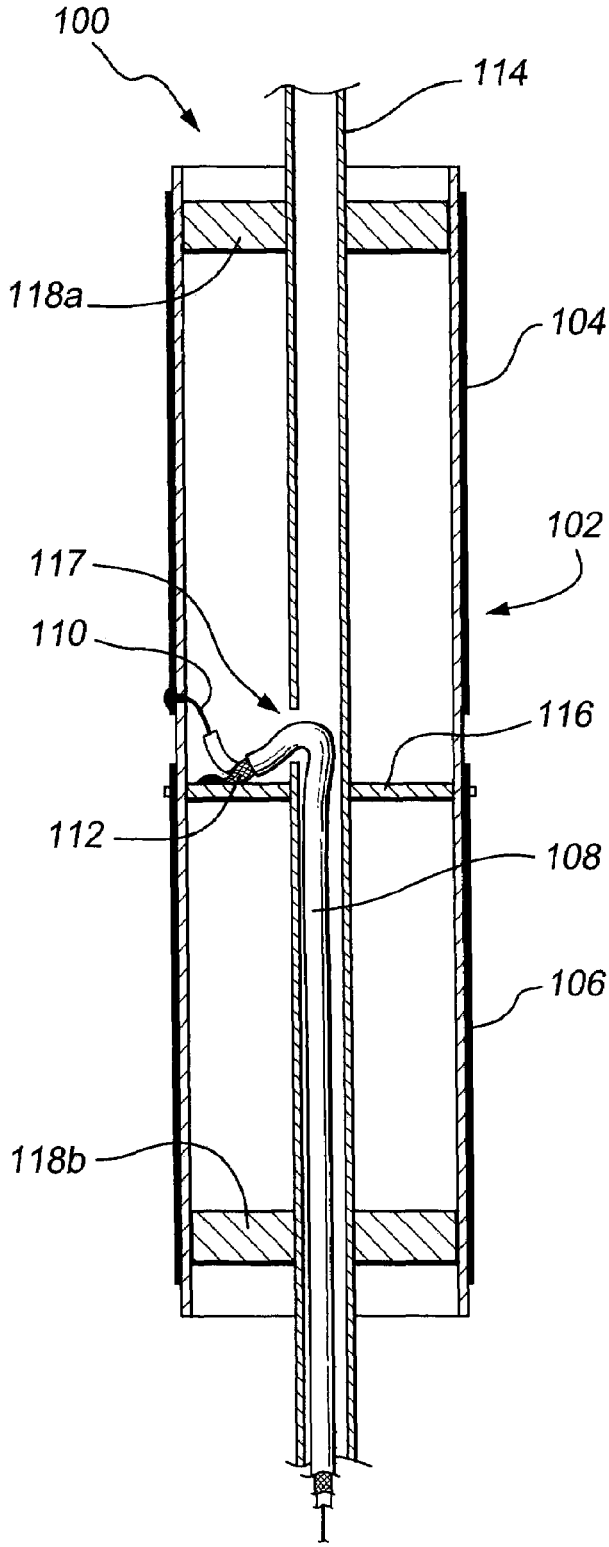

Referring firstly to FIGS. 1A and 1B there is illustrated, in perspective and cross-sectional views respectively, an antenna 100 according to an embodiment of the present invention. The antenna 100 includes an integral dipole antenna member 102, having first and second radiating elements 104, 106 disposed on the surface of a flexible substrate, which has been formed into a substantially cylindrical shape. The antenna 100 further includes a feed network, including at least the coaxial cable feed line 108 having first, central, conductor 110 and second, outer, conductor 112.

It will be appreciated that, as used herein, the terms "feed", "feed line", "feed conductor", "feed network" and so forth are intended to include bi-directional as well as unidirectional circuits, encompassing arrangements for the transmission of signals both to and from the antenna 100. As such, coaxial feed line 108 is provided to conduct signals to and from the radiating elements 104, 106.

The term "network" as used herein has its normal meaning within the technical field of electrical circuit analysis and design, referring to a system of interconnected electrical elements, units or circuits.

The term "cylinder", except where expressly indicated otherwise, or required by the context, has its general meaning as applicable within the mathematical field of geometry. Accordingly, "cylinder" refers to a three dimensional volume bounded by two parallel planes and the surface generated by a straight line moving parallel to a given axis, and intersecting a given curve lying in one of the planes. The solid typically described as a "cylinder" in colloquial use is that which results when the given curve is a circle and the given axis is perpendicular to the planes, more properly known as a "right circular cylinder". In accordance with the particularly preferred embodiments of the antenna described herein, the substrate upon which the radiating elements of the antenna are disposed is formed into a substantially right circular cylindrical form. However, as will be apparent from the following description, the scope of the present invention is not so limited.

The dipole antenna member 102 is supported by central support shaft 114, which according to preferred embodiments of the invention is a grounded metallic tube. A supporting disc 116 is used to provide both mechanical and electrical connection between the support shaft 114 and the dipole antenna member 102. As may be seen in the sectional view of FIG. 1B, the coaxial feed line 108 may be disposed within the hollow central shaft 114, emerging through a hole 117 formed at an appropriate location in the wall of support shaft 114.

While the exemplary antenna 100 includes a coaxial feed line 108, it will be understood that the use of a coaxial cable to feed the antenna is not essential to the invention. Accordingly, in alternative embodiments other forms of feed transmission lines may be employed, including those that will be readily apparent to persons skilled in the art.

According to preferred embodiments of the invention, the outer conductor 112 of coaxial feed line 108 is soldered to the surface of support and grounding disc 116. The disc 116 is shown in top view in FIG. 2, including a central hole 202 through which support shaft 114 passes, and sprockets, e.g. 204, 206 which are formed around the circumference of the disc 116. The sprockets perform the dual functions of providing mechanical support for the dipole antenna member 102, and electrical contact between the disc 116 and the second radiating element 106.

While the use of disc 116 to provide mechanical support and electrical grounding is considered to be particularly advantageous, it will be appreciated that alternative support and grounding arrangements may be employed in alternative embodiments of the invention. For example, the dipole antenna member 102 could equally be supported by an arrangement of spokes disposed around the support shaft 114, which may further provide electrical as well as mechanical contact between the support shaft 114 and the antenna member 102. Further alternative spacing and support structures, including the use of dielectric supports and/or spacers along with alternative electrical grounding arrangements, will also be apparent to persons of skill in the art.

Furthermore, in alternative embodiments the supporting structure need not take the form of a circular disc 116, but may have a different shape corresponding with a desired cross-section of the cylindrical antenna member. For example, other suitable shapes may include, but are not limited to, ovoid, lenticular or biconvex forms providing antennas including cylindrical antenna members having corresponding cross-sectional shapes.

Referring in particular to preferred embodiments of the invention, the metallic disc 116 is welded or soldered to the metallic central support shaft 114, and the sprockets, e.g. 204, 206, of the disc 116 inserted into corresponding holes formed in the flexible substrate of the dipole antenna member 102. These holes are illustrated in FIG. 3, which shows the radiating elements 104, 106 formed on the surface of the flexible substrate in a flat configuration. As shown, the holes 304, 306 correspond with the sprockets 204, 206 shown in FIG. 2. As will be seen, further holes are provided corresponding with the remaining sprockets of the disc 116.

When the sprockets of disc 116 are inserted into the corresponding holes of the dipole antenna member 102, they may be fixed in place, preferably by soldering, in order to provide electrical contact between the disc 116 and the radiating element 106. Accordingly, in preferred embodiments of the antenna 100 the central shaft 114 is grounded, the disc 116 is welded or soldered to the central shaft 114, and is accordingly also grounded, the outer conductor 112 of coaxial feed line 108 is grounded by its connection to the disc 116, and the radiating element 106 is also grounded at its point of contact with the sprockets of disc 116. Overall, this preferred arrangement provides for excellent electrical stability of the dipole antenna member 102.

The central conductor 110 of coaxial feed line 108 similarly passes from the interior of the cylinder formed by dipole antenna member 102 to the exterior through the hole 308 formed in the substrate and first radiating element 104. The central conductor 110 is then preferably soldered in place, thereby providing electrical contact between the conductor 110 and the radiating element 104. Accordingly, a cylindrical dipole antenna structure is provided consisting of radiating members 104, 106 fed by corresponding conductors 110, 112. The dipole antenna member 102 is centre fed with electrical grounding and mechanical support being provided by the central support shaft 114 via metallic disc 116. In order to provide additional mechanical stability, additional disc-shaped dielectric spacers 118*a*, 118*b* are preferably provided proximate to the two open ends of the cylinder formed by the dipole antenna member 102.

The antenna 100 is designed for transmitting and receiving radio signals within a selected frequency band, which may be characterized by its bandwidth and a designed operating frequency, or equivalent wavelength $\lambda$, within the frequency band. According to general theoretical design principles, the vertical length of the radiating elements 104, 106 should be approximately one-quarter of the designed operating wavelength $\lambda$. In practice, the use of radiating elements 104, 106 of exactly one-quarter $\lambda$ in length results in an antenna member having an undesirably low input impedance, which will not be matched to a characteristic impedance of the feed line 108, and which therefore may result in poor antenna performance. Accordingly, it is preferred to provide radiating elements 104, 106 which are slightly greater than one-quarter wavelength in length, for example 0.25 to 0.3 λ, and which therefore present a substantially inductive input impedance.

In order to achieve efficient operation of the antenna 100, over the selected frequency band, it is necessary that the overall input impedance of the dipole antenna member 102 is substantially matched to the characteristic impedance of the feed line 108 over the desired operating bandwidth. According to the invention, this required impedance matching is achieved by arranging the radiating elements 104, 106 on the substrate in order to obtain the desired input impedance. According to preferred embodiments of the invention, this is primarily achieved by controlling the reactive impedance across the two radiating elements 104, 106. A desired reactance may be achieved by appropriate arrangement of the radiating elements 104, 106 on the substrate, and more particularly by controlling the spacing and geometry of the two radiating elements in the region 310 wherein they are in closest proximity.

As will be appreciated from the foregoing description, a particular advantage of the present invention, especially in preferred embodiments, is that the radiating elements may take the form of metallic conductors disposed on the surface of a flexible substrate. More particularly, it is preferred that the radiating elements be formed in a conductive metallic sheet, e.g. of copper or gold, fixed to the surface of a substrate in accordance with conventional printed circuit board (PCB) fabrication techniques. For example, in preferred embodiments the substrate may be the readily-available, low-cost, dielectric material laminate known as FR-4, which is available in flexible form. This approach enables the radiating elements 104, 106 to be formed with a very high degree of repeatability and precision, in a simple manner, and at relatively low cost. Furthermore, all of the well established techniques used in the design of high frequency PCBs, including various microstrip design techniques, may be used to design and realize the radiating elements 104, 106, as well as any additional circuit elements that may be required in order to provide a sufficiently high degree of matching of the input impedance of the antenna member 102 with the characteristic impedance of feed line 108 over the selected operating frequency band of the antenna 100.

Accordingly, the present invention enables many disadvantages of prior art centre-fed coaxial dipole antenna structures to be overcome or mitigated. In particular, it will be understood from the foregoing description that by providing an integral dipole antenna member 102 on which the two radiating elements 104, 106 are both formed in a fixed and predetermined relationship, a reduced number of individual components and corresponding mechanical connections are required in order to assemble the antenna 100. This arrangement is therefore particularly advantageous, in that it provides good mechanical stability, both in construction and over long-term operation, and avoids many of the disadvantages associated with structures having a larger number of individual components and corresponding joints. In particular, antennas formed in accordance with embodiments of the present invention are expected to exhibit significantly less PIM than many known structures, and to do so at a lower cost of assembly. Furthermore, by comparison with many known antenna structures, embodiments of the present invention may be lighter in weight, thereby reducing costs of transportation, installation and maintenance.

Figure 2:
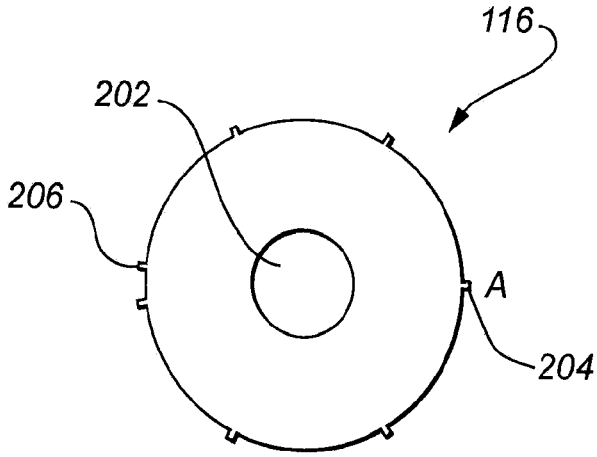
FIG. 2 illustrates a support and grounding disc of an antenna according to an embodiment of the invention.
Figure 3:
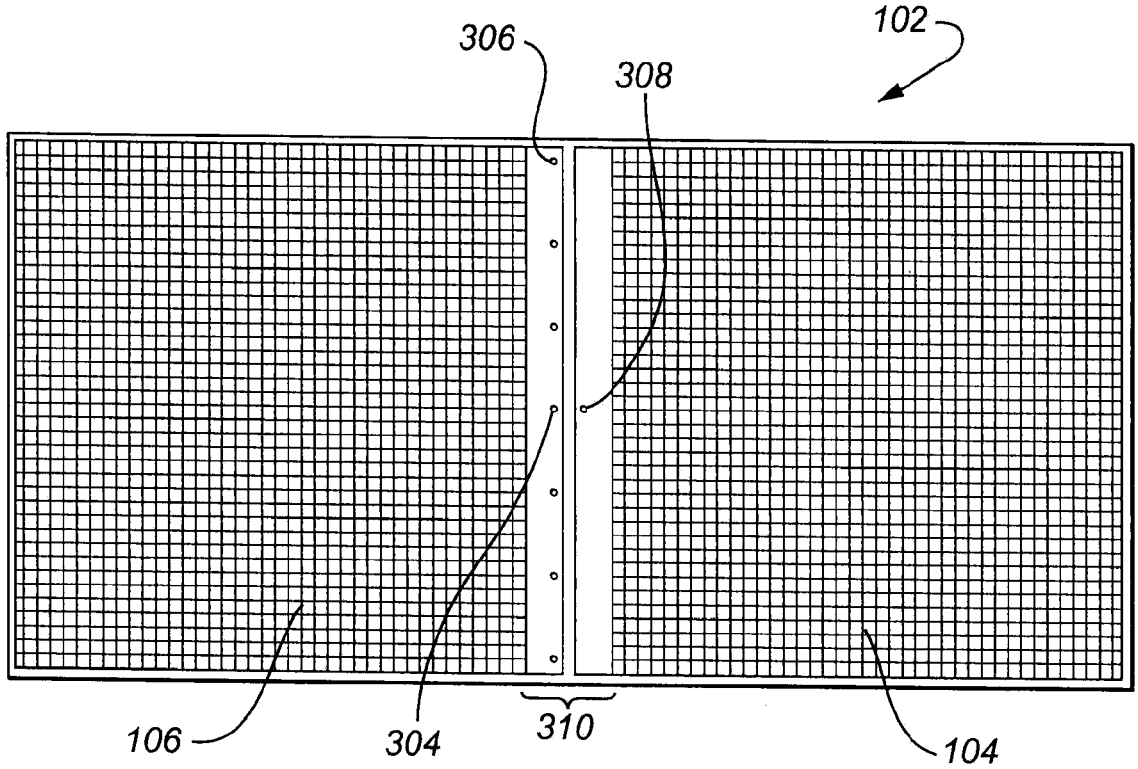
FIG. 3 shows radiating elements formed on a flexible substrate in accordance with a preferred embodiment of the invention.
Figure 4:
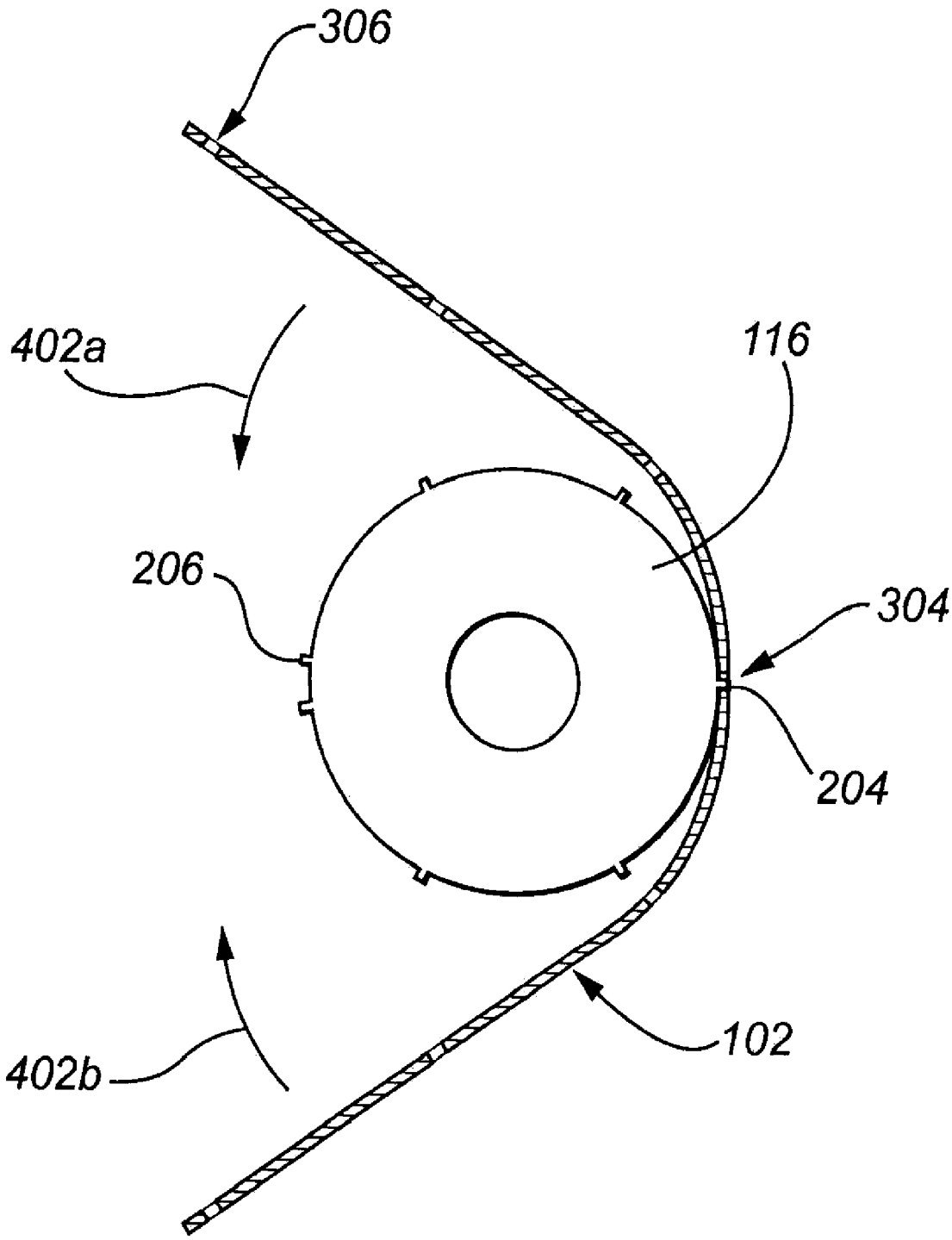
FIG. 4 illustrates the assembly of a support and grounding disc and radiating elements, as shown in FIGS. 2 and 3, according to a preferred embodiment of the invention.

FIG. 4 further illustrates the simple method of assembly of a substantially cylindrical dipole antenna from the flexible antenna member 102 and disc 116 illustrated in FIG. 3 and FIG. 2 respectively. The two radiating elements 104, 106 having been formed on the surface of a flexible substrate using conventional PCB fabrication techniques, the resulting flexible antenna member 102 is formed into a substantially cylindrical shape around the metallic disc 116, as indicated by arrows 402*a*, 402*b*. As shown, sprocket 204 of disc 116 is inserted into hole 304 in antenna member 102, while sprocket 206 is inserted into hole 306. Other sprockets around the circumference of disc 116 are inserted into corresponding holes, and all may then be fixed in place by soldering the sprockets to the surface of metallic radiating member 106. The step of rolling the flexible antenna member 102 around the disc 116 may be conducted either before or after the disc is affixed to the central support shaft 114, however in practice it may be more practical to weld the disc 116 to the shaft 114, and solder conductor 112 of feed line 108 to the disc 116, prior to rolling the flexible antenna member 102 around the disc, and soldering it into place. Finally, central conductor 110 may be soldered to radiating element 104, thereby completing construction of the centre-fed dipole antenna 100.

Figure 5:
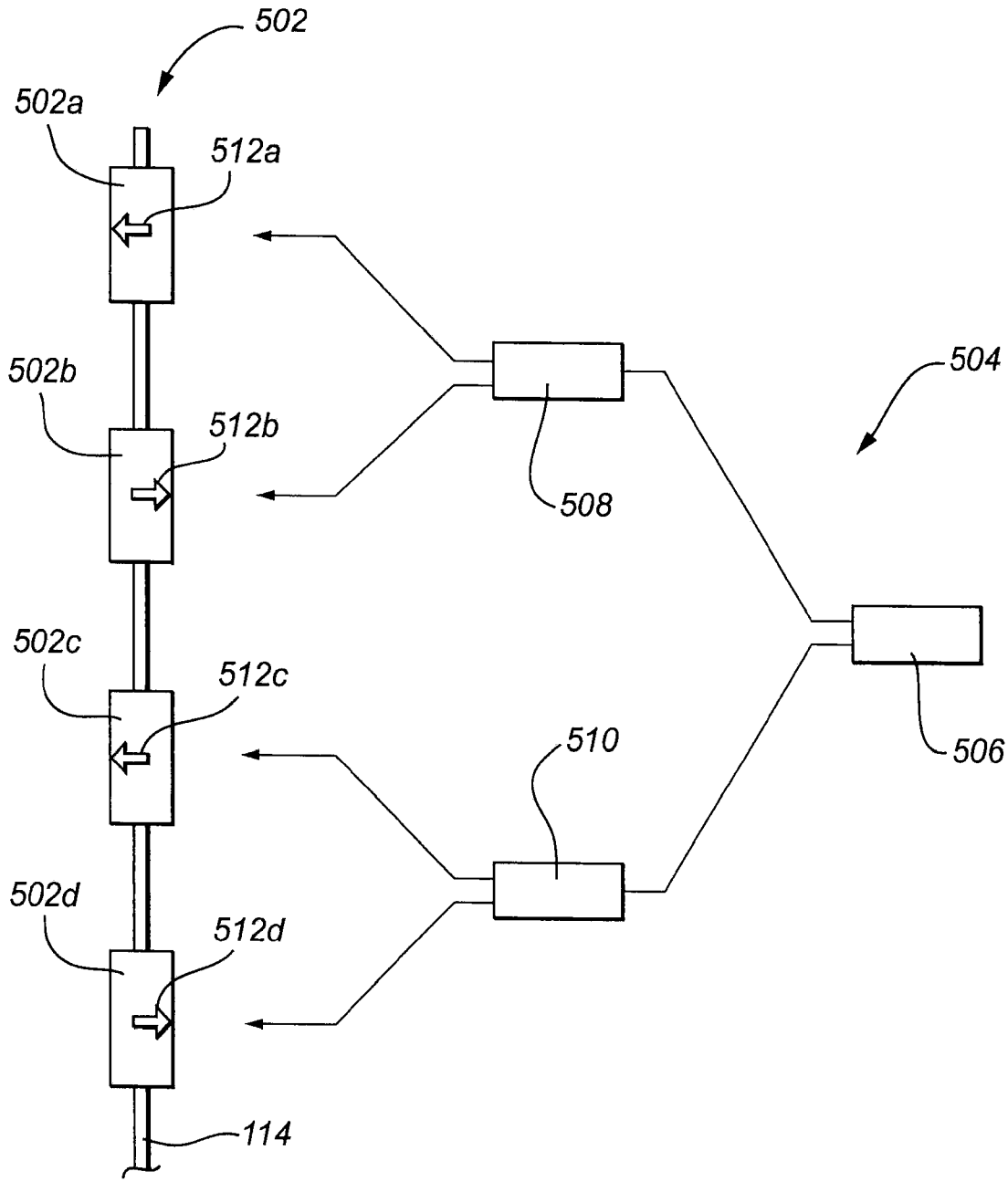
FIG. 5 is a schematic diagram of a four-member dipole array and feed circuit according to an embodiment of the invention.

While a single dipole antenna member is able to function as an antenna, in many applications it is desirable to provide an antenna having higher gain than is provided by a single dipole antenna member. FIG. 5 illustrates a collinear array 502 of four dipole antenna members 502*a*, 502*b*, 502*c*, 502*d* fixed to a common central shaft 114. Also shown schematically in FIG. 5 is a corporate (or parallel) feed network 504 for providing all four dipole antenna members with an in-phase signal. The corporate feed network 504 includes a first power divider 506, for splitting an input signal into two separate paths, which are provided to further power dividers 508, 510. The power divider 508 in turn splits the signal into two in-phase components, which are provided to dipole antenna members 502*a* and 502*b*. Similarly, power splitter 510 divides its input into two further in-phase components, which are provided to dipole antenna members 502*c* and 502*d*. Accordingly, all four dipole antenna members are corporate-fed via corresponding feed lines with in-phase signals in parallel. As a result, the radiated fields from the antenna array 502 add in-phase around the horizon, resulting in an overall increase in gain, as compared with a single dipole antenna member, of approximately 6 dB.

Each of the dipole antenna members 502*a*, 502*b*, 502*c*, 502*d* is designed and constructed in like manner to the dipole antenna 100, as previously described with reference to FIGS. 1 to 4, in order to ensure that each antenna member has an input impedance which is substantially matched to the characteristic impedance of the corresponding feed lines over the operating frequency band of the antenna array 502. If desired, successive dipole antenna members may be oriented differently about the central shaft 114. For example, as illustrated in FIG. 5, successive antenna members, e.g. 502*a*, 502*b*, 502*c*, 502*d*, are oriented such that the respective feed points are located on alternately opposing sides of the central shaft 114, as indicated by the arrows 512*a*, 512*b*, 512*c*, 512*d*. Such an arrangement may be particularly advantageous where a substantially omnidirectional radiation pattern in azimuth is desired, since propagation effects over the respective radiating elements of the antenna members may generally result in slight asymmetries in radiation pattern. Accordingly, by alternating, or rotating, the orientation of each successive antenna element, such inherent asymmetries may be "averaged out", such that overall the antenna 502 has an improved omnidirectional radiation characteristic.

Figure 6A:
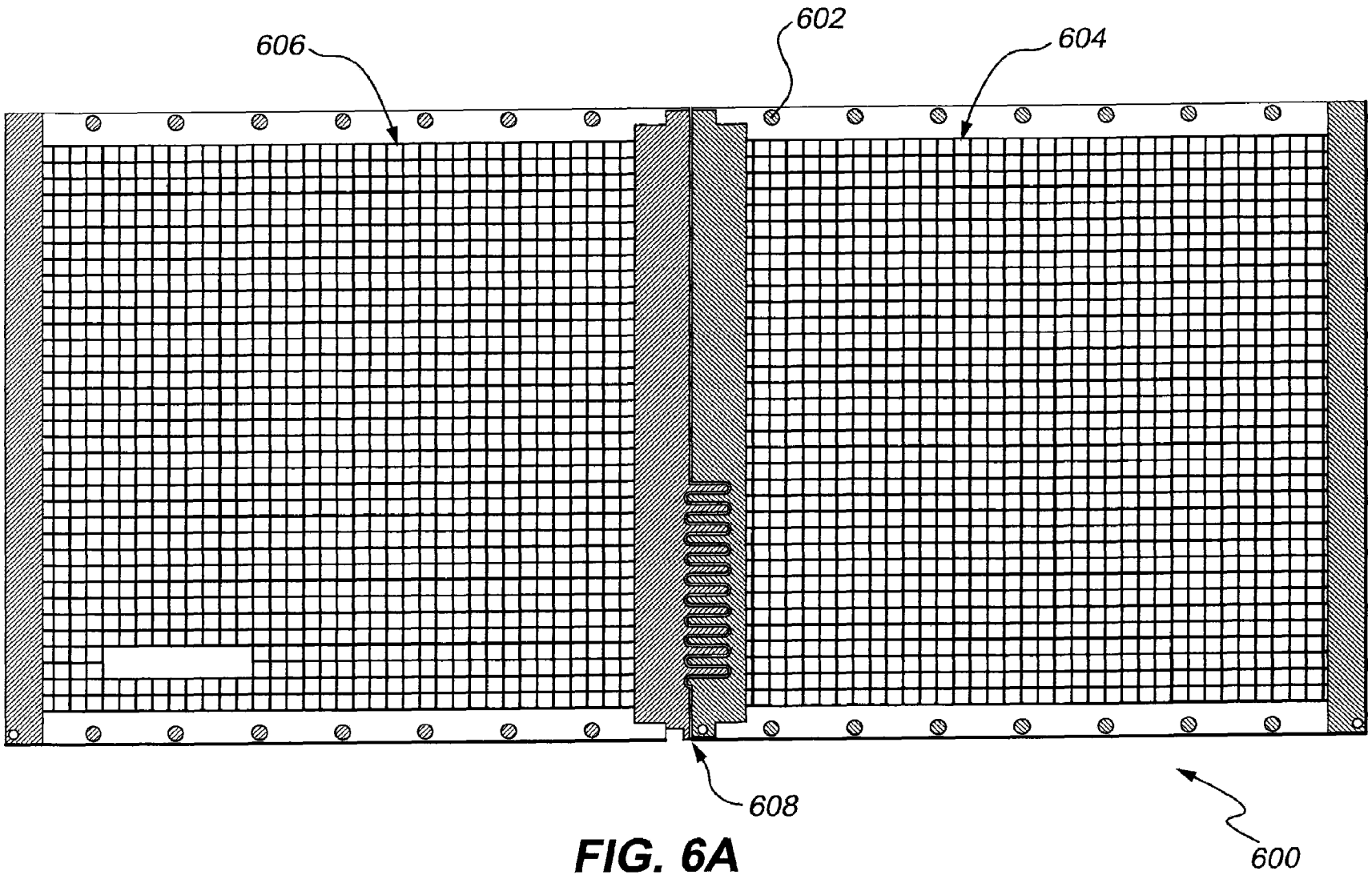
FIGS. 6A, 6B and 6C show alternative arrangements of radiating elements formed on a flexible substrate including various capacitive impedance matching arrangements, according to preferred embodiments of the invention.
Figure 6B:
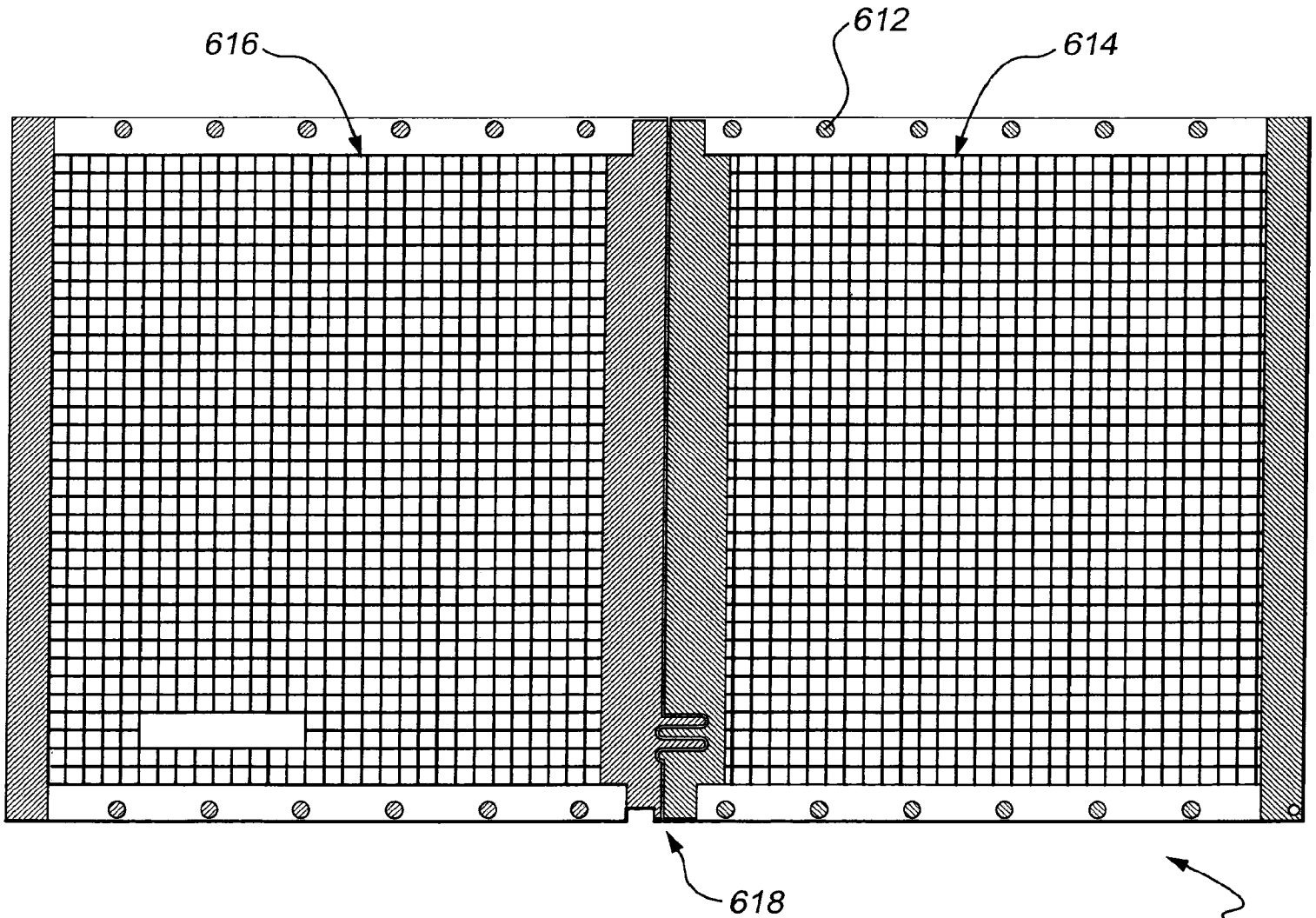
Figure 6C:
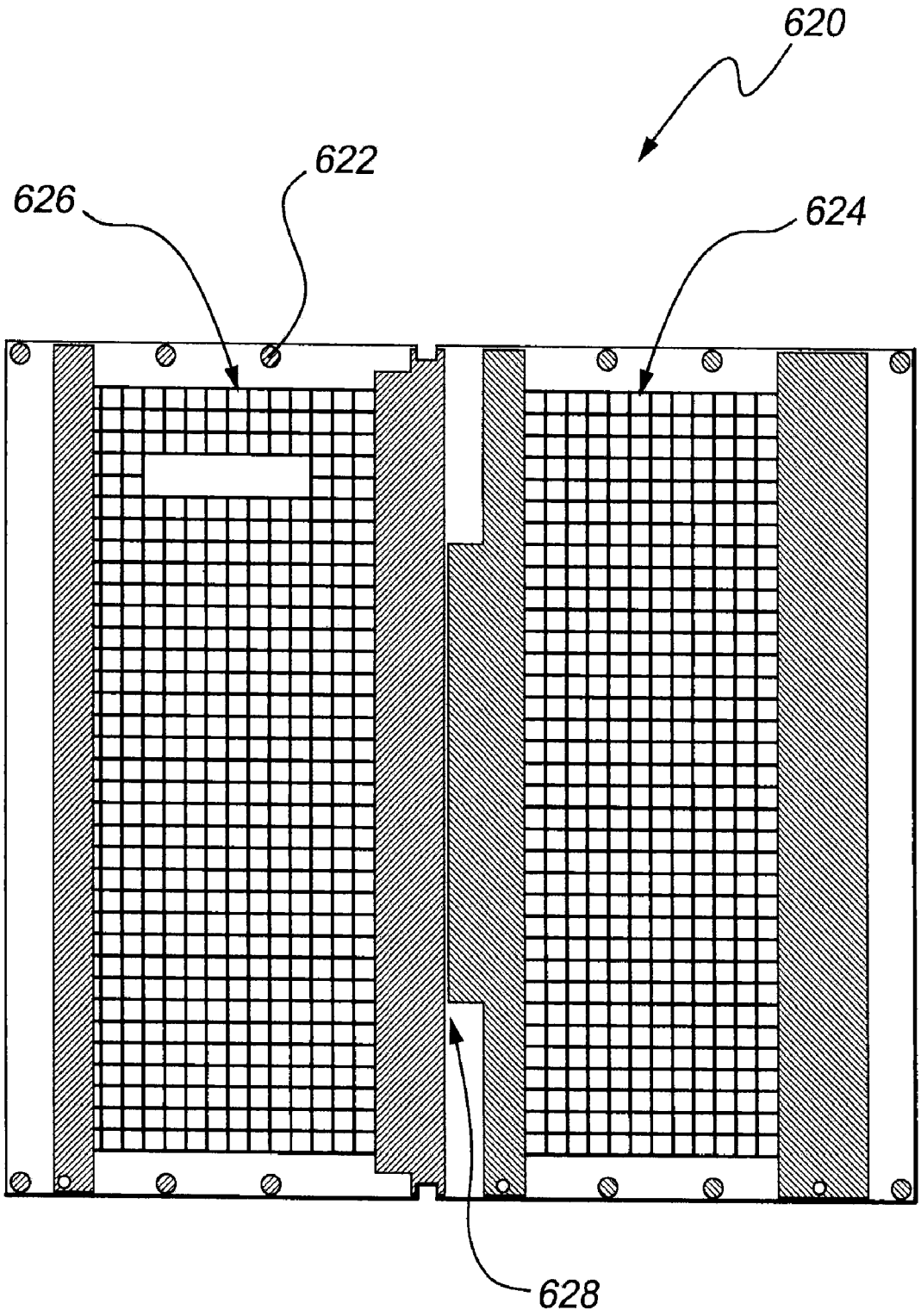

FIGS. 6A, 6B and 6C illustrate printed circuit board layouts 600, 610, 620 providing radiating elements for three particular antennas in accordance with embodiments of the invention. More specifically, each of these three embodiments has been designed to operate within a different frequency range.

The layout 600 illustrated in FIG. 6A includes radiating elements 604, 606 designed to provide an antenna operating within the frequency range of 380 MHz to 420 MHz. When laid out flat, as shown in the FIG., the total length of the integral dipole antenna member, as measured from one end of the dipole to the other (i.e. from left to right in the FIG.) is approximately 408.5 mm. The width of the antenna member, corresponding approximately with the circumference of the final cylindrical dipole, is about 195 mm. The total length of the gap 608 provided between the two radiating elements 604, 606 affects the capacitance between the radiating elements. In particular, it may be seen that the gap 608 includes a "zig zag" portion forming an interdigital shunt capacitor between the radiating elements 604, 606. The embodiment 600 thereby illustrates the manner in which additional circuit elements may be provided in order to control the capacitance between the radiating elements. In particular, the interdigital shunt capacitor provides an increased capacitance between the elements, which is required to provide impedance matching to the antenna feed line over the operating frequency range of 380 MHz to 420 MHz.

As will be appreciated, interdigital shunt capacitors represent only one type of planar circuit element that is known for use in the design of printed circuits for radio frequency applications. Accordingly, this and various other planar structures may readily be employed to provide the requisite matching between the characteristic impedance of the feed line and the input impedance of the dipole antenna member in various embodiments of the invention. While it will be appreciated that some design iteration, for example through theoretical modeling, computer simulation and/or prototype construction, may be required initially in order to optimize the design of the radiating elements on the substrate, once a suitable design has been obtained the production and construction of further antennas in accordance with the design is a straightforward matter using known methods of PCB fabrication.

In FIG. 6B, there is illustrated a PCB layout 610 including radiating elements 614, 616, which is designed for operation within the frequency range of 450 MHz to 520 MHz. In this example, the length of the dipole antenna member is approximately 350 mm, and the width (approximate circumference of the completed cylinder) is about 195 mm. As in the layout 600, a gap 618 is provided between the elements 614, 616 in order to control the capacitance therebetween. Once again, an interdigital capacitor portion is provided to extend the length of the gap 618 in order to increase the total capacitance so as to achieve impedance matching. At the higher frequency of operation of this embodiment, a shorter interdigital capacitor portion is required as compared with the layout 600 which is designed for operation at lower frequencies.

FIG. 6C shows a further PCB layout 620 including radiating elements 624, 626 designed for operation within the frequency range 746 MHz to 870 MHz. The total length of the layout is approximately 216 mm, and the width is approximately 195 mm. A gap 628 provided between the radiating element 624, 626 is once again designed in order to provide a desired capacitance between the elements, for the purposes of matching impedance with the feed line over the operating frequency range. In the layout 620, the gap 628 does not include an interdigital shunt capacitor portion, and instead the gap includes regions of expanded width intended to reduce the capacitance between the radiating elements 624, 626. As will be appreciated, the further increase in operating frequency over those for which the layouts 600, 610 have been designed results in a further reduced capacitance requirement in order to achieve impedance matching. Overall, therefore, the three layouts 600, 610, 620 clearly illustrate the advantage of the present invention that radiating elements may readily be arranged on the substrate such that, in use, the input impedance of the dipole antenna member is substantially matched to the characteristic impedance of the feed line over a selected frequency band.

Also shown in the layouts 600, 610, 620 are respective series of holes, e.g. 602, 612, 622, distributed along the opposing edges of the dipole antenna members which are brought together when the flexible substrate is formed into a cylindrical shape. The holes assist in assembling the completed antenna, and may significantly simplify construction. In particular, once the flexible substrate having the desired radiating elements formed thereon has been formed into a cylinder, for example around a metallic disc or other support as previously described in particular with reference to FIG. 4, the corresponding opposing edges may be fixed together by using rivets inserted through respective pairs of holes. Since the dielectric materials of the flexible substrate may lack sufficient mechanical strength to support the rivets, and to provide long term integrity when in use, additional supporting structures may be provided if required. For example, in one preferred embodiment a plastic strip is provided (not shown in the drawings) which includes holes formed at intervals corresponding with the holes, e.g. 602, 612, 622, formed along the opposing edges of the cylindrical antenna member. The strip is then aligned with the antenna member such that rivets may be passed through the corresponding holes in the antenna member and the plastic strip, whereby the strip provides mechanical reinforcement in the completed dipole antenna member. While alternative techniques, such as soldering, gluing and so forth, may be utilized to fix the opposing edges of the antenna member together, the use of rivets provides a particularly quick, simple, effective and robust method for constructing an antenna. If desired, solder or other electrically conductive bridging material may be provided between opposing conductive edges of the respective radiating elements in order to improve electrical contact therebetween.

Figure 7:
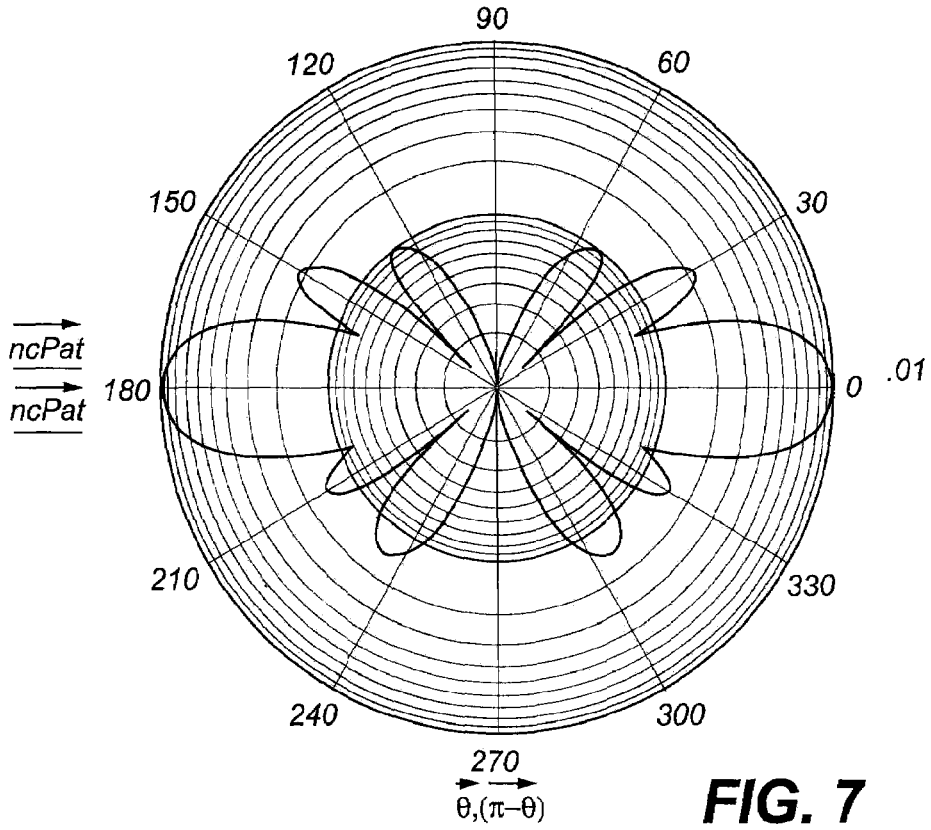
FIG. 7 shows a radiation pattern produced by a four-member array such as illustrated in FIG. 5.
Figure 8:
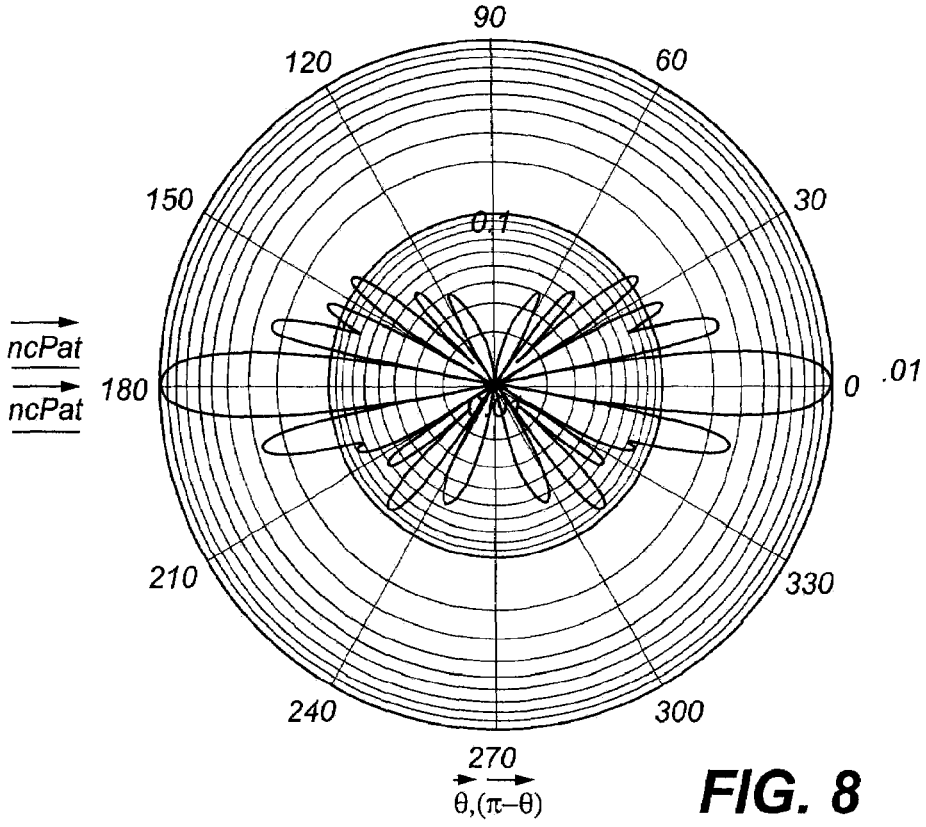
FIG. 8 shows a radiation pattern produced by an eight-member array according to an embodiment of the invention.

Finally, FIGS. 7 and 8 illustrate typical E-plane radiation patterns that may be produced by a four-member array and eight-member array respectively, of corporate-fed dipole antenna members arranged using the collinear antenna structure illustrated in FIG. 5. As will be appreciated, a larger number of dipole antenna members in the array results in a higher gain at the horizon, at the expense of a lower vertical beam width and a larger number of lobes in the radiation pattern. It will be appreciated that the cylindrical dipole structures described with reference to FIGS. 1 to 6 result in a substantially omnidirectional radiation pattern in azimuth, although it should be appreciated that the invention is not limited to the design and construction of uniformly omnidirectional antennas. For example, by manipulating the coverage provided by the radiating elements over the substrate, antennas having differing radiation profiles around the horizon may be provided. Such antennas may be produced by, for example, forming the substrate into an incomplete cylinder, by providing a complete cylindrical substrate having dipole elements which do not fully and/or uniformly cover the substrate around the circumference thereof, or by forming cylinders having non-circular profiles, Additionally, while an in-phase corporate feed of antenna elements has been described with reference to FIG. 5, it will be appreciated that by controlling the phasing of signals provided to each antenna element, for example through appropriate design of power dividers 506, 508, 510, antennas exhibiting a desired degree of vertical tilt may be provided. In particular, in applications such as mobile telephony wherein the mobile radio units may be located generally below the horizon relative to the location of base station antennas, a controlled degree of downward tilt may be desirable.

As a further possible variation, two or more antennas covering different frequency bands could be provided within a single radome by providing multiple arrays of dipole antenna members, each array being designed for a different frequency band, about a single supporting shaft or mast 114.

It will therefore be readily apparent to those skilled in the art that many variations of the present invention are possible, and that the invention is not to be limited to the particular embodiments described herein. Rather, the scope of the invention is defined by the claims appended hereto.

We claim:

1. An antenna for transmitting and receiving radio signals within a selected frequency band, comprising:

an integral dipole antenna member comprising a substantially cylindrical substrate formed from a flexible dielectric sheet material which has disposed on a surface thereof first and second radiating elements in a substantially collinear arrangement parallel to a longitudinal axis of the cylindrical substrate; and a feed line including at least first and second feed conductors operatively in electrical contact with said first and second radiating elements respectively, to conduct signals to and from the radiating elements, wherein the radiating elements are arranged on the substrate such that in use an input impedance of the dipole antenna member is substantially matched to a characteristic impedance of the feed line over the selected frequency band.

2. The antenna of claim 1 wherein a length of each radiating element along said longitudinal axis is approximately equal to, or slightly greater than, one quarter wavelength at a predetermined central frequency within the selected frequency band.

3. The antenna of claim 2 wherein said first and second radiating elements are formed so as to provide a desired capacitance therebetween in order to achieve matching to the characteristic impedance of the feed line over the selected frequency band.

4. The antenna of claim 1 wherein said first and second radiating elements are formed so as to provide additional circuit elements in order to match the input impedance of the dipole antenna member to the characteristic impedance of the feed means.

5. The antenna of claim 4 wherein said additional circuit elements include one or more of parallel capacitive elements or interdigital capacitive elements.

6. The antenna of claim 1 wherein each of said first and second radiating elements is formed to provide substantially uniform coverage about a circumference of the substantially cylindrical substrate.

7. The antenna of claim 1 wherein a cross section of the substantially cylindrical substrate is substantially circular, ovoid, lenticular or biconvex in shape.

8. The antenna of claim 1 further comprising a disc positioned adjacent to a convex interior surface of the cylindrical substrate, the disc and substrate comprising cooperating connecting members for fixing the substrate in position around the disc, whereby the disc supports the integral dipole antenna member.

9. The antenna of claim 8 further comprising a central support shaft, and wherein the disc comprises a central hole through which said support shaft passes.

10. An antenna for transmitting and receiving radio signals within a selected frequency band, comprising:

an antenna array including a plurality of collinear integral dipole antenna members, each having first and second radiating elements disposed on a surface of a substantially cylindrical substrate; and a corporate feed structure directing a plurality of feed lines, each including respective first and second feed conductors operatively in electrical contact with each of said first and second radiating elements in the antenna array, wherein the radiating elements of each antenna member are arranged on the corresponding substrate such that in use an input impedance of each dipole antenna member is substantially matched to a characteristic impedance of the corresponding feed line over said selected frequency band.

11. The antenna of claim 10 wherein the corporate feed structure comprises an electrical network including at least one power divider for splitting an input signal into a plurality of separate feed line paths directing a corresponding plurality of in-phase signals to respective ones of the plurality of integral dipole antenna members.

12. The antenna of claim 10 wherein said substrate of each said antenna member comprises a flexible dielectric sheet material, and wherein the first and second radiating element of each antenna member are disposed on the surface of the substrate in a substantially collinear arrangement parallel to a longitudinal axis of the cylindrical substrate.

13. The antenna of claim 10 wherein a length of each radiating element along a longitudinal axis of the cylindrical substrate of each antenna member is approximately equal to, or slightly greater than, one quarter wavelength at a predetermined central frequency within the selected frequency band.

14. The antenna of claim 13 wherein said first and second radiating elements of each said dipole antenna member are formed so as to provide a desired capacitance therebetween in order to achieve matching to the characteristic impedance of a corresponding feed line over the selected frequency band.

15. The antenna of claim 10 further comprising a central support shaft, wherein the substrate of each dipole antenna member is formed around a metallic disc which includes a central hole, through which the support shaft passes, whereby each antenna member in the array is mounted coaxially along the length of the support shaft.

16. A method of manufacturing a dipole antenna, comprising the steps of:

forming first and second radiating elements on the surface of a flexible substrate, the radiating elements including respective feed points for making operative electrical contact with a feed line including at least corresponding first and second feed conductors, wherein the radiating elements are arranged on the substrate such that in use an input impedance of the dipole antenna is substantially matched to a characteristic impedance of the feed line over a selected frequency band;

forming the flexible substrate into a substantially cylindrical shape having a longitudinal axis; and wherein the first and second radiating elements are formed on the substrate such that they are disposed in a substantially collinear arrangement parallel to said longitudinal axis.

17. The method of claim 16 wherein the step of forming the substrate into a substantially cylindrical shape comprises rolling the substrate into a cylinder.

18. The method of claim 16 wherein the step of forming the substrate into a substantially cylindrical shape comprises rolling the substrate around a rigid supporting structure, and fixing the substrate to the supporting structure.

19. The method of claim 16 further comprising the steps of:

providing a rigid supporting structure having projecting sprockets arranged about an outer periphery thereof;

forming holes in the substrate corresponding with said projecting sprockets; rolling the substrate around said supporting structure such that the sprockets are received within the holes formed in the substrate;

fixing the sprockets of the supporting structure into the holes in the substrate.

20. The method of claim 19 wherein said rigid supporting structure is formed in the shape of a disc.

* * * * *